United States Patent [19]

Devilbiss

[11] 4,054,020

[45] Oct. 18, 1977

[54] APPARATUS FOR INSERTING SPACER MEMBERS BETWEEN TWO UPRIGHT ARTICLES

[75] Inventor: Roy Joseph Devilbiss, Richmond, Va.

[73] Assignee: Philip Morris Incorporated, New York, N.Y.

[21] Appl. No.: 724,859

[22] Filed: Sept. 20, 1976

[51] Int. Cl.[2] ..... B65B 61/00

[52] U.S. Cl. ..... 53/128; 53/157; 93/36.01

[58] Field of Search ..... 53/128, 156, 157; 93/36.01; 198/34

[56] References Cited

U.S. PATENT DOCUMENTS

| | | | |
|---|---|---|---|
| 3,125,840 | 3/1964 | Cross | 53/157 |
| 3,760,557 | 9/1973 | McIntyre | 53/157 X |
| 3,872,647 | 3/1975 | Langen et al. | 53/157 |

*Primary Examiner*—Frank T. Yost

*Attorney, Agent, or Firm*—Watson, Leavenworth, Kelton & Taggart

[57] ABSTRACT

Apparatus for inserting a panel spacer between two articles in which a housing carrying cam fingers moves from an upper position to a lower position so as to engage the tops of the articles with the cam fingers to tilt and separate them whereupon a panel insert held in the housing is released and drops between the articles with there also being provided a plunger blade to fully insert the panel spacer and also to prevent the dropping from the housing of a spacer member next above.

17 Claims, 6 Drawing Figures

APPARATUS FOR INSERTING SPACER MEMBERS BETWEEN TWO UPRIGHT ARTICLES

BACKGROUND OF THE INVENTION

It is known to pack cigarette packages containing smaller than standard size cigarettes in cartons normally used for standard sized cigarette packages. This is done in order that tax marking of such packages can be effected with existing package marking machines. To that purpose, panel members customarily are inserted in the cigarette cartons to compensate for the difference between the space occupied by the ten smaller than standard size cigarette packages and that available in the carton, such spacers or panel members also functioning to position the packages within the carton in placements as allow proper tax markings. Representative of the forms of such panel spacer members are those described in U.S. Pat. Nos. 3,489,272 and 3,752,308. It has been commonplace to insert such known panel members in the cigarette cartons by hand during packing in the cigarette manufacturing facility, particularly since these panel forms do not lend themselves readily to automatic machinery effected insertion operations. Thus while such panel members fulfill their intended purpose they do not allow for optimized and economical use of modern high speed packing procedures in the cigarette production line.

SUMMARY OF THE PRESENT INVENTION

The present invention relates to apparatus for inserting a panel spacer member intermediate the juxtaposed ends of upright articles arranged in side-by-side alignment. It is applicable to the procedures as attend insertion of such panel spacer members at the opposite ends of the middle pair of cigarette packages in a carton of cigarette packages and more particularly is intended for use with a panel spacer member of the type described in pending application Ser. No. 629,095 which panel spacer member is a single-ply, relatively stiff corrugated component that has the advantage that it can be formed from a stock of material at a location adjacent the panel insertion station.

The apparatus is intended for use at a panel spacer insertion station in the manufacturing line along which cartons filled with cigarette packages are being conveyed, the bottom closure flaps of the inverted carton not having been sealed and being folded open at the time a carton reaches the point at which panel spacer member insertion is to be carried out. At the insertion station, the carton conveyor will be stopped and disposed such that the juncture, i.e., the juxtaposed ends, of the pairs (front and rear) of packages in which insertion is to be made will be centrally located relative to the inserter apparatus.

In accordance with the present invention, the apparatus comprises an inserter head unit which is a housing having parallel front and rear walls and being open at one end, the head unit having a first upper position and a second lower position and being mounted for movement between said two positions. Two pairs of elongated cam fingers are pivoted to the respective front and rear walls of the housing at the inner surfaces thereof and extend downwardly from the lower edge of the housing, there being also provided abutment means which maintain the fingers acutely angularly inclined to the horizontal in a normal stop position when the head unit is in its raised or first position in such position, the lower or free end of the pairs of fingers being spaced apart a greater distance than the upper ends. There also is provided a vertically disposed string of panel spacer members, the lowermost member in the string being disposed in the head unit and there being means for releasably holding the lowermost spacer member in the head unit against the action of gravity when the head unit is in its upper or first position, such means preferably being provided as pins on certain of the cam fingers which pins in the raised position locate under the lower edge of the lowermost spacer member. The spacer members as mentioned are provided in a vertically disposed string of such panel spacer members and can be formed adjacent the insertion station from a roll stock of relatively stiff paper material which is passed through a corrugating roller unit to form a spacer of the type disclosed in the above-mentioned pending application, the spacers thereafter being severed to provide individual ones of said spacers and then fed vertically to the housing unit. Guidance slots are provided in the housing to direct vertical passage of the spacer members through the head unit for insertion between the juxtaposed ends of the pairs of cigarette packages as shall be described more fully shortly.

The apparatus also includes an elongated plunger blade member which when the head unit is in its first or upper position is disposed adjacent the housing and supported so that it can be subjected to both vertical and horizontal travel relative to the head unit.

To effect insertion of a panel spacer member between the juxtaposed ends of two pairs of cigarette packages in the cigarette carton, the inserter head unit is caused to move downwardly from its first to second position during the course of which movement, the cam fingers at the bottom of the housing engage the tops of the respective pairs of cigarette packages with the downward motion of the housing causing the cam fingers to rotate in outwardly directed opposite rotational courses and applying force to the cigarette packages tending to tilt them in opposite directions away from each other to thereby provide an enlarged space between their juxtaposed ends. During the course of the movement of the housing from its first to second positions, the spacer retainer pins carried by the cam figures rotate downwardly and as the housing approaches its second lower position release the lowermost spacer member so that it drops by gravity into the enlarged space between the pairs of cigarette packages.

During the course of the travel of the housing from its first to second positions, the elongated plunger blade member also has movement imparted to it both in the vertical and horizontal directions so as to cause a tip end of the blade member to enter the opening in the end of the housing and position itself between the lowermost spacer member and that next above in the string so that when the lowermost spacer has been released, the spacer next above will be restrained from dropping from the housing. The plunger blade also has a further downward movement applied thereto so as to apply a downward thrust to the lowermost spacer and fully insert it between the two cigarette packages. The housing unit is then returned from its second to first positions during the course of which travel, the plunger blade member also is raised upwardly while retaining the tip end of the said next above panel member on top of the blade tip end until the housing has returned to its first or upper position wherein the cam fingers having returned to the position normally occupied when the housing is in its upper position assume the function of retaining the spacer member on the pins carried by said cam fingers.

The invention accordingly, comprises the features of construction, combination of elements and arrangement of parts, which will be exemplified in the construction hereinafter set forth and the scope of the invention will be indicated in the claims.

BRIEF DESCRIPTION OF THE DRAWINGS

A fuller understanding of the nature and objects of the present invention will be had from the following detailed description taken in conjunction with the accompanying drawings showning by way of example, a preferred embodiment of the inventive concept and in which.

Throughout the following description, like reference numerals are used to denote like parts in the drawings.

DESCRIPTION OF THE PREFERRED EMBODIMENT

The present invention, which is concerned with apparatus for inserting a panel spacer member between the juxtaposed ends of two upright articles arranged in side-by-side alignment will be described further with reference to the manner in which such apparatus is used for inserting a panel spacer member between two pairs of cigarette packages in a carton filled with cigarette packages. However, it would be understood that the invention has broader applicability and can be used for a wide variety of purposes wherein it is desired to insert a spacer or like component between the ends of two aligned articles.

Figure 1:
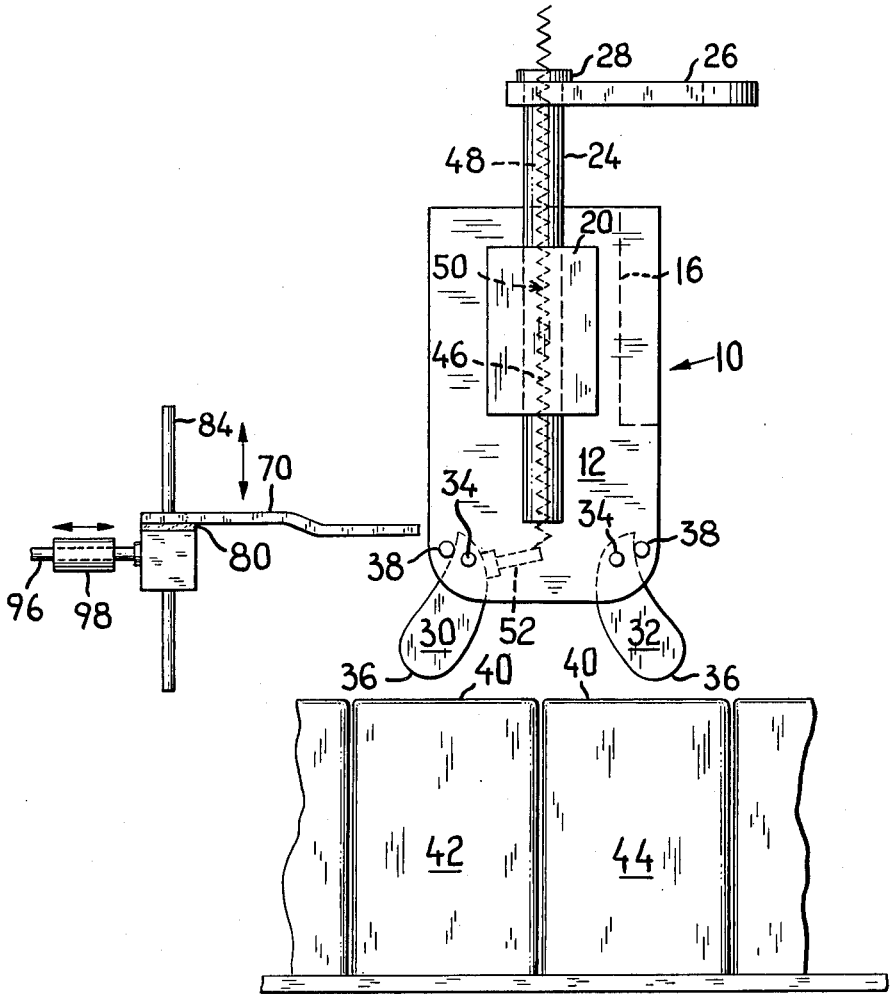
FIG. 1 is a front elevational view of the apparatus of the present invention with the head unit being shown in its upper or first position and their being a string of panel spacer members provided, the lowermost of which is diposed in the housing and held therein by retainer pins carried on the cam fingers, the blade member being in an elevated and withdrawn position relative to the housing with certain specific features of construction of the apparatus which are shown in FIG. 2 not being shown in FIG. 1 for sake of clarity of depiction, the apparatus being shown as it is disposed above two pairs of packages of cigarettes in a carton of such packages being conveyed on a conveyor unit and between which a panel member is to be inserted.
Figure 2:
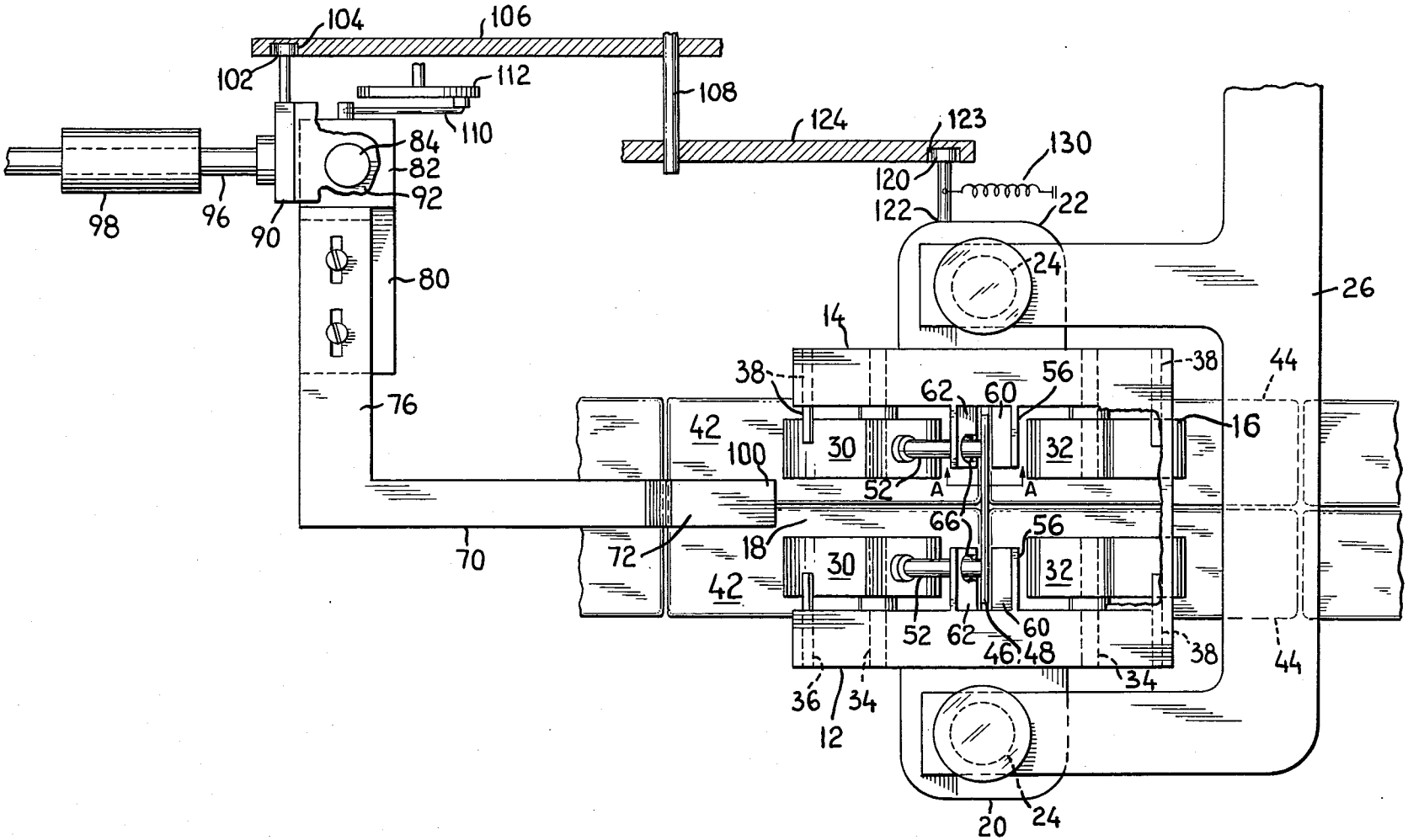
FIG. 2 is a top plan view on enlarged scale of the apparatus of FIG. 1, some parts being broken away with said Figure further depicting the means for imparting horizontal and vertical motion to the plunger blade member and for raising the housing unit from its second to first positions.

With reference now to FIGS. 1 and 2 of the drawings, the apparatus of the present invention includes an inserter head unit 10 which is a vertically elongated housing structure having opposed front and rear side walls 12 and 14, wall structure 16 at one end and being open at the other end as at 18. The front and rear walls 12, 14 of the housing carry the respective mounting blocks 20, 22 in which are received vertical posts 24, to thus provide that the head unit can be slid vertically from a first or upper position as shown in FIG. 1 to a second or lower position, the lowermost extent to which the head unit moves being when the lower edge of the housing locates at the line B—B in FIG. 4*b*. The vertical posts 24 are connected as at 28 with enlarged head parts or like means to an overhead bracket unit 26 which bracket in turn can be secured to any suitable mounting structure (not shown) in the manufacturing line at or adjacent the insertion station. The housing carries front and rear pairs of cam fingers 30, 32 which are mounted on pivots 34 extending through the respective front and rear walls with the cam fingers being carried at the inner sides of said walls. The cam fingers 30, 32 are elongated members with the upper ends being at the pivots and the lower ends presenting rounded article engaging surfaces as at 36, there further being provided stop abutments in the form of pins 38 carried in the housing adjacent the cam fingers upper ends and which when the unit is in its first or upper position maintain the cam fingers disposed angularly acutely to the horizontal and such that the lower ends of the cam fingers of each pair are at greater distances from each other than the upper ends of said cam fingers. The purpose of thus mounting the cam fingers to be angularly acutely inclined to the horizontal is to insure smooth engagement with the bottoms 36 thereof against the tops 40 of the cigarette packages 42, 44 to insure that further rotative movement of the cam finger pairs will be in opposite directions to apply tilting force to said packages upon movement of the housing from its first to second positions.

Figure 3:
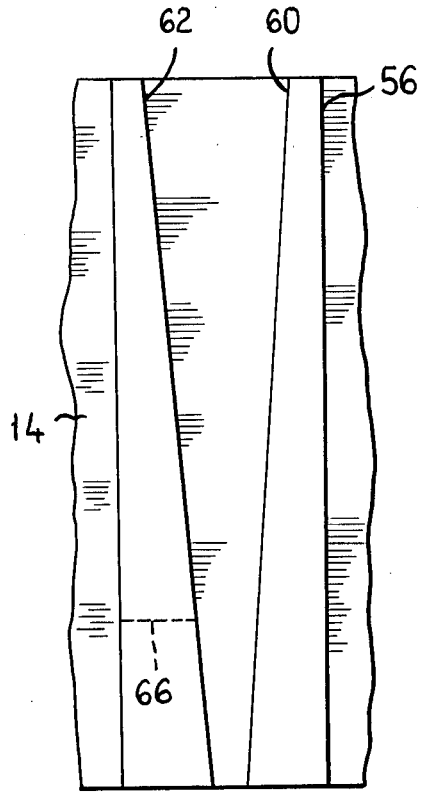
FIG. 3 is a fragmentary elevational view on enlarged scale as taken along the line A-A in FIG. 2.

A string of panel spacer members is provided and the lowermost panel spacer member 46 is disposed in the housing when the housing is in its first position, there being a further spacer member 48 next above, the two depicted spacer members having edge to edge juncture as at 50 and while being in vertical alignment are not connected together. The character of the spacer members is described more fully in pending application Ser. No. 620,095, and they have the advantage that they can be formed from a roll of paper stock disposed some distance above the inserter unit which is passed though a corrugating unit, and then fed into the inserter unit, suitable quide means and cutting means (not shown) for effecting the foregoing being employed such means not forming part of the present invention. When the lowermost panel spacer 46 in the string is received in the head unit with the same in its upper position, retainer means in the form of pins 52 carried on one of the cam fingers of each pair of such cam fingers locate in position as seen in FIG. 1 to receive and retain the lowermost spacer member and prevent it from falling through the housing under the influence of gravity. Such retaining support by pins 52 continues after the head unit starts to descend from its first to second positions, and until a predetermined point where the pins will rotate to release the spacer 46 but by which time the plunger blade member will have been inserted so as to take over support of the spacer member next above in the manner as shall be described later. To facilitate guidance of the panel spacer members in the head unit, the same is provided with guide means in the form of structure 56 as shown particularly in FIG. 2. Such structure includes slideways extending inwardly of the housing from the inner surfaces of the respective or front and rear walls 12 and 14, such slideways having two inclined sides 60 and 62 which merge from top to bottom so as to form a converging channel or slot in which is received side marginal portions of the spacer members. The slideway parts 56 at the left side in FIG. 2 are provided with clearance slots 66 in which the pins 52 carried on the cam fingers 30 move during their rotative movements. Further detail of the guide means slideways is shown in FIG. 3.

With reference again to FIGS. 1 and 2, the blade plunger member 70 which is an elongated relatively thin member having a vertically offset right end portion as 72 is supported for both vertical and horizontal movement relative to the head unit. As can be seen best in FIG. 2, the blade member 70 has a rearwardly directed right angularly placed extension piece 76 which is fixedly secured to an angle bracket 80, the later in turn being secured to a slide block 82. The slide block 82 is carried on a vertical shaft 84 which is fixed to a mounting frame 90, the mounting frame 90 being a structure (as viewed in vertical profile) of substantially C-shaped cross section, the vertical shaft 84 being fixed to the webs 92 of the mounting frame. The mounting frame 90 in turn is connected to a horizontal shaft 96 and the shaft in turn is slidably mounted in a fixed horizontal mounting block 98. Thus it will be noted that the inserter blade member can be subjected to both horizontal and vertical movements relative to the housing and to the extent that the blade member tip and 100 can be inserted through the opening 18 at the left side of the housing for positioning of said tip end intermediate the lowermost spacer 46 of the string and that spacer 48 next above and adjacent the cam fingers during operation of the unit. a particularly advantageous form of means for imparting both horizontal and vertical movement to blade 70 will be described next.

A cam follower member 102 is fixedly connected to mounting frame 90 and is engaged in the cam track 104 of a rotary cam 106 carried on rotatable shaft 108. Upon rotation of the cam 106, rotary motion is converted to horizontal straightline motion for sliding the mounting block horizontally of the housing in each of two opposite directions. For effecting vertical movement up and down of the blade member 70, the slide block 82 has fixedly connected thereto a crank arm 110 which in turn is connected to a rotary crank member 112. In this manner a vertical up-and-down motion can be imparted to the blade member. FIG. 2 also shows the means by which the housing can be raised from its lower or second position to its upper or first position. A cam follower 120 fixedly connected to the housing structure as at 122 is engaged with the track 123 of a rotary cam member 124 which upon rotation of same converts rotary to vertical straight-line motion for raising the housing unit. As will appear later, the housing unit is intended to descend from its first to second position by means of the force of gravity which gravity imposed descent can be assisted by a biasing spring 130 connected to the cam follower 120. Those skilled in the art will readily understand how to provide particular cam profiles to effect the foregoing movements, and also the advantage of mounting both cams on a common drive shaft 108 particularly when the respective movements follow a particular sequence.

Figure 4A:
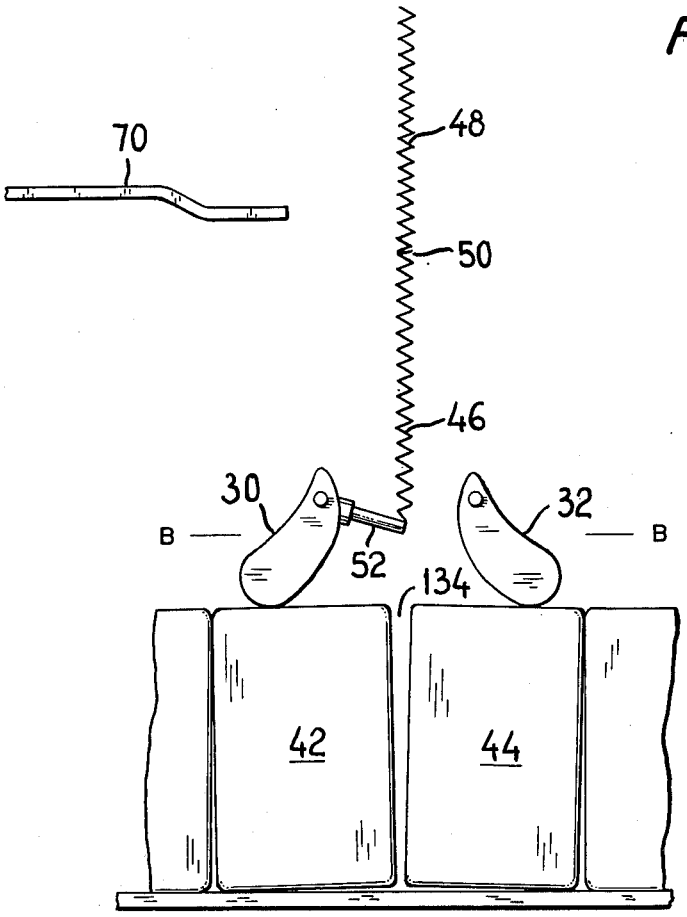
FIG. 4*a* '–*4c* depict diagrammatically the sequence of movements of the housing unit and blade member during the course of the insertion of a panel spacer member between the two pairs of cigarette packages.
Figure 4B:
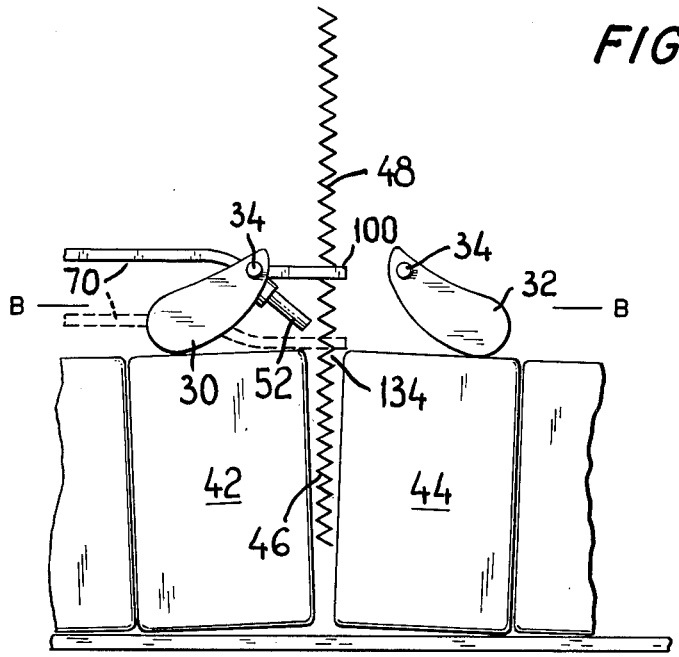
Figure 4C:
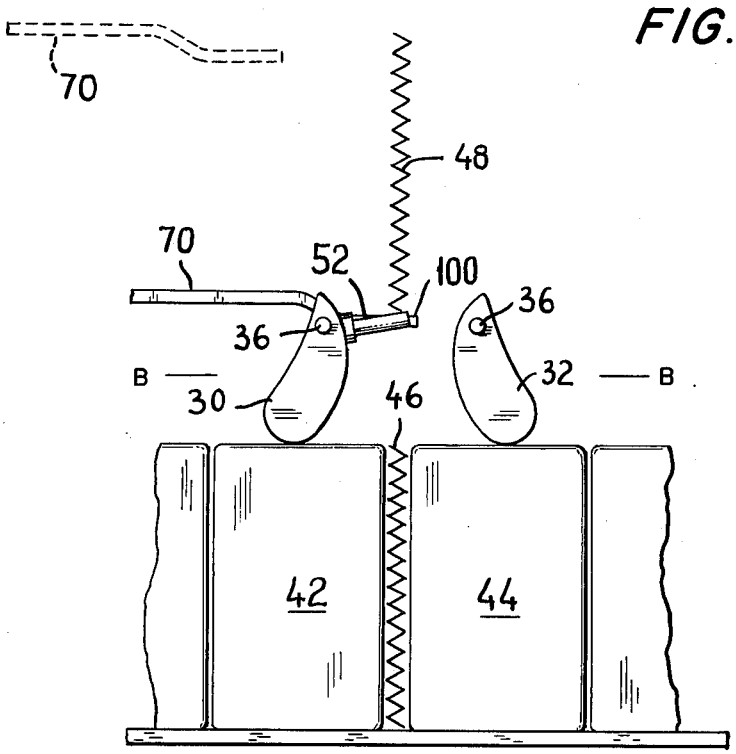

Further understanding of the invention can be had by describing the manner in which the apparatus is employed to insert a panel spacer member between two pairs of cigarette packages 42 and 44 (in FIG. 2) when said packages are disposed below the inserter unit at the insertion station. With further and continuing reference to FIGS. 4*a*–4*c*, the inserter unit when the packages have been properly stationed, starts to descend by gravity with assist from spring 130 from its first to its second position such event being part of a readily controlled cycle of operation of the unit. During the course of such a descent and as soon as the lower ends of the cam fingers 30, 32 have engaged the tops of the cigarette packages 42 and 44, the cam fingers will start to rotate in opposite directions and further outwardly of each other under such action functioning to apply a tilting force to the packages tending to enlarge the space 134 between the juxtaposed ends thereof. The point at which the fingers have engaged the tops of the cigarette packages and initiated tilting is shown in FIG. 4*a*, the lower edge of the housing being at that point located at the line B—B. In such position it will be noted, the pins 52 on cam fingers 30 still retain the lowermost spacer member 46 and the next above spacer member 48 is restrained by the upper edge of the lowermost spacer member, both spacer members moving down, however, in the housing slideway structure 56. It also will be noted that at such point the blade member 70 is in an elevated and withdrawn position relative to the housing. However, upon continued descnt of the housing, the cam fingers will continue to rotate until the same closely approach the generally more horizontal position shown in FIG. 4*b* and until finally they have rotated to such extend that the pins 52 will have released their hold on the lower edge of the lowermost spacer member. However, before the lowermost spacer member is released by pins 52, the blade member 70 will have been caused to and enter the head unit through the opening 18 and be positioned adjacent the cam fingers and intermediate the lowermost spacer member and that next above it in the string so that the upper surface of the tip end 100 of the blade member will support the spacer 48. As seen in FIG. 4*b*, the blade member has downward movement to the position shown in dashed lines so as to apply downward thrust to fully insert the spacer member 46 in the enlarged space 134 between the juxtaposed ends of packages 42 and 44, the fully inserted position of the spacer 46 being shown in FIG. 4*c*.

Following the full insertion of the panel spacer 46 in between packages 42 and 44, the rotary cam 124 is employed to raise the housing from its second to first positions so as to recycle the unit for the next succeeding insertion operation. However, during the ascent of the housing, the blade member 70 which is still supporting the spacer member 48 also is raised remaining within the housing so as to maintain its support of spacer member 48 until the housing has returned fully upwardly to its first position, in which position the cam fingers 30, 32 will have rotated back to the position shown in FIG. 1 the pins 52 thereon resuming the function of supporting the spacer member 48. The blade member is then withdrawn from the housing to the position shown in dashed lines in FIG. 4*c* to await commencement of the next cycle of insertion.

When employed for inserting the panel spacers intermediate adjacent pairs of packages of cigarettes in a carton, the placement of the same will be effected as shown in U.S. Pat. No. 3,752,308. That is, spacer members will be placed at each side of the center pair of cigarette packages as shown in said patent. However, it is desirable for such insertion operation that there by provided two inserter units along the production line so that after the first insertion has been effected, the carton will be conveyed to the second unit for insertion of the second panel member at a second insertion station.

As those skilled in the art will appreciate, there are various ways that the blade member movement can be controlled as well as the function of raising the inserter head. However, a particularly preferred manner of rotating the cam members 106 and 124 is to drive them from a common shaft. Furthermore, those skilled in the art will appreciate that gravity movement of the head unit from its first to second positions can be provided for by proper formation of the cam track on rotary cam 120.

From the foregoing it will be appreciated that the apparatus of the present invention is particularly advantageous in that it permits high speed automated insertion of panel members in between packages of cigarettes in a carton thereof and is a form of apparatus which is readily integrated into the overall cigarette manufacturing line.

While there is disclosed but one embodiment of apparatus of the present invention, it is possible to present still other embodiments without departing from the scope of the inventive concept herein disclosed, and accordingly, it should be understood that all matter contained in the above description, and in the accompanying drawings should be interpreted as illustrative and not in a limiting sense.

What is claimed is:

1. Apparatus for inserting a panel spacer member intermediate the juxtaposed ends of two upright articles arranged in side-by-side alignment, said apparatus comprising an inserter head unit, means for supporting said head unit for vertical movement between a first upper position and a second lower position and vice versa, a vertically disposed string of panel spacer members, the lowermost spacer member in said string being disposed in said head unit and there being means for releaseably holding said lowermost spacer member in said head unit against the action of gravity and when said head unit is in its first position, means carried at the lower part of said head unit and operable during movement of said head unit from its first to second positions for engaging the tops of said articles and applying force thereto tending to tilt same in opposite directions away from each other to thereby provide an enlarged space between their juxtaposed ends, said spacer holding means being operable during movement of said head unit from its first to second positions for releasing said lowermost spacer member from its held position in said head unit whereby said lowermost spacer member drops into said enlarged space, an elongated plunger blade member, means disposed adjacent said head unit for supporting said blade member for vertical and horizontal travel relative to said head unit, and means imparting both vertical and horizontal movement to said blade member during the course of movement of said head unit from its first to second positions for positioning a tip end of the blade member between said lowermost spacer member and that next above in the said string after said head unit has moved a predetermined distance from its first to second positions and thereafter applying with said tip end a downward thrust to said lowermost spacer to fully insert it between said articles, said motion imparting means further being operative to retain the tip end of said blade member positioned below said next above spacer member when said head is moved upwardly from its second to first positions.

2. The apparatus of claim 1 in which said inserter head unit is a housing having opposed front and rear walls an an opening at one end, the article engaging means comprising a pair of elongated cam fingers pivoted at one end to one of said opposed walls, the other ends of said cams presenting rounded article engaging surfaces, downward movement of said housing when said fingers are in contact with said articles causing said caming fingers to rotate in opposite directions.

3. The apparatus of claim 2 in which stop abutments are carried in said housing adjacent the said one ends of said cam fingers and so positioned therein that when said head unit is in its first position said cam fingers are acutely angularly inclined relative to the horizontal and the lower ends thereof spaced apart a greater distance than the upper ends.

4. The apparatus of claim 2 in which the spacer holding means comprises a pin member carried at an upper part of one of said cam fingers, said lowermost spacer member being supported on the tip end of said pin member when said head unit is in its first position.

5. The apparatus of claim 2 in which the means for supporting said head unit for vertical movement comprises bored slide blocks carried on the front and rear walls of said housing, and vertical posts received in said slide blocks, said posts being in fixed parallel spacing one with the other.

6. The apparatus of claim 2 in which guide means are provided in said housing for guiding the passage of spacer members therethrough.

7. The apparatus of claim 6 in which said guide means comprises structure extending vertically of said housing and carried at the inner sides of at least one of said housing front and rear walls, said structure defining a vertically extending slot in which a side marginal part of the spacer member locates during passage through the housing.

8. The apparatus of claim 7 in which said guide means structure is disposed intermediate the mounting locations of said cam fingers.

9. The apparatus of claim 8 in which the spacer holding means comprises a pin member carried at an upper part of one of said cam fingers on the tip end of which is received the lowermost spacer member when the head unit is in its first position, said guide means structure being provided with a slotted clearance passage at the lower end thereof in which said pin member moves upon rotation of same during the course of rotative movements thereof.

10. The apparatus of claim 8 in which like guide means structure is provided on the inner surface of the other of said front and rear walls.

11. The apparatus of claim 2 in which the pair of cam fingers are carried at the inner surface of the wall to which they are pivoted, the opening in said one end of said housing being positioned such as to admit entry of said blade member into said housing and adjacent said cam fingers during movement of said head unit from its first to second positions.

12. The apparatus of claim 2 in which the housing is provided with a pair of elongated cam fingers carried at the inner side of each of said front and rear walls of said housing.

13. The apparatus of claim 12 in which the corresponding cam fingers of each pair of cam fingers are mounted on a common pivot axis.

14. The apparatus of claim 1 in which said head unit is movable between its first and second positions under the influence of gravity, there further being provided power means to raising said head unit from its second to first positions.

15. The apparatus of claim 14 in which spring biasing means are operatively connected with said head unit to assist movement thereof from its first to second positions.

16. The apparatus of claim 1 in which the means for supporting said blade member for horizontal travel includes a horizontal shaft slidable in a horizontally fixed mounting block, an end of the shaft being connected with a mounting frame, the means for supporting said blade member for vertical travel including a vertical shaft fixed in said mounting frame and a slide fitting slidable on said vertical shaft, said blade member being fixed connected with said slide fitting.

17. The apparatus of claim 16 in which the means for imparting vertical and horizontal movement to said blade member comprises a rotary crank and a crank arm connected therefrom to said slide fitting for vertically moving said blade member, said means further including a cam follower fixed to said mounting frame and engaged with a rotary cam operative to move said blade member horizontally.

* * * * *